US009918500B2

(12) United States Patent
Tempesta

(10) Patent No.: US 9,918,500 B2
(45) **Date of Patent: *Mar. 20, 2018**

(54) WRAP FRONT BRA

(71) Applicant: NIKE, Inc., Beaverton, OR (US)

(72) Inventor: Laura Tempesta, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/616,203

(22) Filed: Jun. 7, 2017

(65) Prior Publication Data

US 2017/0265528 A1 Sep. 21, 2017

Related U.S. Application Data

(63) Continuation of application No. 14/845,666, filed on Sep. 4, 2015, now Pat. No. 9,700,082.

(Continued)

(51) Int. Cl.

| | |
|---|---|
| ***A41C 3/00*** | (2006.01) |
| ***A41C 3/02*** | (2006.01) |
| ***A41F 1/00*** | (2006.01) |

(52) U.S. Cl.

CPC ..... *A41C 3/0057* (2013.01); *A41C 3/0028* (2013.01); *A41C 3/0035* (2013.01); *A41C 3/02* (2013.01); *A41F 1/006* (2013.01)

(58) Field of Classification Search

CPC ..... A41C 3/00; A41C 3/02; A41C 3/0057; A41C 3/0028; A41C 3/148; A41F 1/00; A41F 1/006; A41D 1/14

(Continued)

(56) References Cited

U.S. PATENT DOCUMENTS 1,306,595 A * 6/1919 Jerome ..... A41C 3/00 2/110

1,352,974 A 9/1920 Kops (Continued)

FOREIGN PATENT DOCUMENTS

EP 2601849 A1 6/2013

OTHER PUBLICATIONS

Non-Final Office Action dated Aug. 11, 2017 in U.S. Appl. No. 15/616,207, 9 pages.

(Continued)

*Primary Examiner* — Gloria Hale

(74) *Attorney, Agent, or Firm* — Shook, Hardy and Bacon L.L.P.

(57) ABSTRACT

A sport bra having an adjustable underband tightening assembly is provided herein. The sport bra comprises a front portion having a pair of breast covering structures, a pair of shoulder straps, and a front underband segment having a first end and a second end. The sport bra further comprises a back portion having a central body portion, a pair of shoulder straps secured to the shoulder straps of the front portion, and a back underband segment comprising a first wing extending away from a first side of the back underband segment and terminating in a first end and a second wing extending away from a second side of the back underband segment and terminating in a second end. The first and second ends of the back underband segment are adapted to releasably and adjustably secured to the front underband segment in an as-worn configuration.

20 Claims, 7 Drawing Sheets

Related U.S. Application Data

(60) Provisional application No. 62/050,990, filed on Sep. 16, 2014.

(58) Field of Classification Search
USPC ..... 450/83–87; 2/210–212, 220, 221, 2/235–237
See application file for complete search history.

(56) References Cited

U.S. PATENT DOCUMENTS 1,530,504 A * 3/1925 Lenkowsky ..... A41D 1/14 2/211
1,681,119 A * 8/1928 Kennedy ..... A41C 3/00 450/85
2,364,899 A * 12/1944 Hatton ..... A41C 3/00 450/28
2,402,835 A * 6/1946 Nagy ..... A41C 3/00 2/67
2,542,881 A * 2/1951 Ries ..... A41C 3/0078 450/59
2,970,597 A * 2/1961 Milton ..... A41C 3/02 24/442
3,256,886 A * 6/1966 Sachs ..... A41C 3/00 450/59
3,306,299 A * 2/1967 Paramore ..... A41C 3/0007 2/67
3,378,013 A * 4/1968 Bruno ..... A41C 3/00 450/58
3,465,754 A * 9/1969 Lockwood ..... A41C 3/00 450/1
3,551,528 A 12/1970 Randall et al.
3,771,528 A * 11/1973 May ..... A41C 3/00 450/74
4,781,651 A * 11/1988 Ekins ..... A41C 3/0057 450/25
D300,980 S 5/1989 Mathis
5,045,019 A * 9/1991 Capasso ..... A41C 3/00 2/73
5,180,326 A * 1/1993 Williams ..... A41C 3/148 2/73
5,863,236 A * 1/1999 Johnson ..... A41F 1/006 450/60
5,908,346 A 6/1999 McCall et al.
5,951,364 A 9/1999 Brown et al.
6,023,785 A * 2/2000 Johnson ..... A41C 3/0057 2/62
6,068,538 A * 5/2000 Alleyne ..... A41C 3/02 450/1
6,431,947 B1 * 8/2002 Henz ..... A41C 3/00 450/86
6,572,437 B1 * 6/2003 Waitz ..... A41C 3/0064 450/1
D575,026 S 8/2008 Tonsor
D597,278 S 8/2009 Cavosie
8,007,343 B1 8/2011 Komsky
8,337,275 B2 * 12/2012 Martins-Crawbuck ..... A41C 3/0028 450/62
8,690,634 B2 * 4/2014 Heath ..... A41C 3/0057 450/40
D739,642 S 9/2015 Valencia
9,700,081 B2 * 7/2017 Tempesta ..... A41C 3/0057
9,700,082 B2 * 7/2017 Tempesta ..... A41C 3/0057
2003/0089083 A1 * 5/2003 Phillips ..... B65B 11/48 53/411
2009/0233522 A1 * 9/2009 Schlatmann ..... A41C 3/0057 450/39
2011/0117818 A1 * 5/2011 Barnard ..... A41C 3/0057 450/58
2011/0177757 A1 * 7/2011 Swendseid ..... A41C 3/0028 450/70
2011/0201252 A1 * 8/2011 Campbell ..... A41C 3/0021 450/39
2016/0081398 A1 * 3/2016 Tempesta ..... A41C 3/0057 450/70
2016/0081399 A1 * 3/2016 Tempesta ..... A41C 3/0057 450/70
2017/0202273 A1 * 7/2017 Tempesta ..... A41C 3/0057

OTHER PUBLICATIONS

Notice of Allowance dated Jul. 19, 2017 in U.S. Appl. No. 15/459,143, 5 pages.

* cited by examiner

WRAP FRONT BRA

CROSS-REFERENCE TO RELATED APPLICATIONS

This application, assigned U.S. application Ser. No. 15/616,203, entitled "Wrap Front Bra," and filed Jun. 7, 2017, is a continuation application of U.S. application Ser. No. 14/845,666, entitled "Wrap Front Bra," filed Sep. 4, 2015 and now issued as U.S. Pat. No. 9,700,082 on Jul. 11, 2017. The '082 Patent was filed concurrently with and incorporates by reference U.S. application Ser. No. 14/845,655, entitled "Wrap Back Bra," filed Sep. 4, 2015 and now issued as U.S. Pat. No. 9,700,081 on Jul. 11, 2017. Both the '081 and '082 Patents claim the benefit of priority to U.S. Provisional Application No. 62/050,990, filed Sep. 16, 2014, and entitled "Wrap Back Bra." The entireties of the aforementioned applications are incorporated by reference herein.

BACKGROUND

Sport racerback bras may be advantageous because their configuration enables a wide range of movement of the back and arms of the wearer without strap slippage. In contrast to more traditional bras that clasp in the back or front, racerback sport bras are typically constructed as a unitary piece that is donned by pulling over a wearer's head and doffed the same way. More specifically, typical racerback sport bras generally comprise a unitary main body panel that extends in a continuous circle around the front, sides, and the back of a wearer when worn. Because these types of sport bras are generally constructed from elasticized fabrics to ensure a tight fit and adequate support, this configuration may make it difficult to both don and doff the sport bra. This is particularly true when the sport bra or the wearer is saturated with perspiration. Moreover, because a typical racerback sport bra utilizes a single main body panel, there is no ability to adjust the girth of the sport bra to provide customized support.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects described herein are directed toward a racerback sport bra configured to be easily donned and doffed and configured to have a customizable girth. In exemplary aspects, the sport bra, in an as-constructed but un-assembled configuration, comprises a front portion and a back portion, where the front portion is unaffixed to the back portion except for a pair of shoulder straps. In other words, unlike conventional racerback bras where the bra comprises a unitary main body panel that generally extends in a continuous circle around the front, sides and the back of a wearer when worn, the front portion of the bra described herein is not joined to the back portion of the bra along the sides of the bra but instead comprises a separate piece from the back portion except for the shoulder strap connection. When in an as-worn and assembled configuration, an underband segment of the back portion of the bra may be releasably and adjustably affixed to an underband segment of the front portion by an adjustable underband tightening assembly. The adjustable underband tightening assembly described herein enables the girth of the sport bra to be increased while donning and doffing and then decreased once it is on a wearer's body so that the bra fits snugly and provides adequate support. The adjustable underband tightening assembly described herein further enables the wearer to adjust the girth of the bra during wear to accommodate different activities and/or movements.

In exemplary aspects, the sport bra may comprise a front portion having a pair of breast cups, a pair of shoulder straps, and a front underband segment, and a back portion having a central body region, a pair of shoulder straps that, in an as-constructed arrangement are fixedly or releasably secured to the shoulder straps of the front portion, and a back underband segment. In exemplary aspects, the adjustable underband tightening assembly may comprise extensions of the back underband segment (hereinafter known as "wings") that extend laterally away from the back underband segment of the sport bra and terminate in a first free end and a second free end. The wings are configured to be wrapped around the sides of a wearer to the front of the wearer where the first and second free ends can be releasably and adjustably secured to the front underband segment. When donning or doffing the sport bra, the wings can be adjustably loosened or even released thereby allowing the girth of the sport bra to increase which eases the process of donning and doffing the sport bra. Moreover, during wear, the wings can be loosened and/or tightened to provide customized support to the wearer.

BRIEF DESCRIPTION OF SEVERAL VIEWS OF THE DRAWINGS

The present invention is described in detail below with reference to the attached drawing figures, wherein.

DETAILED DESCRIPTION

Figure 1:
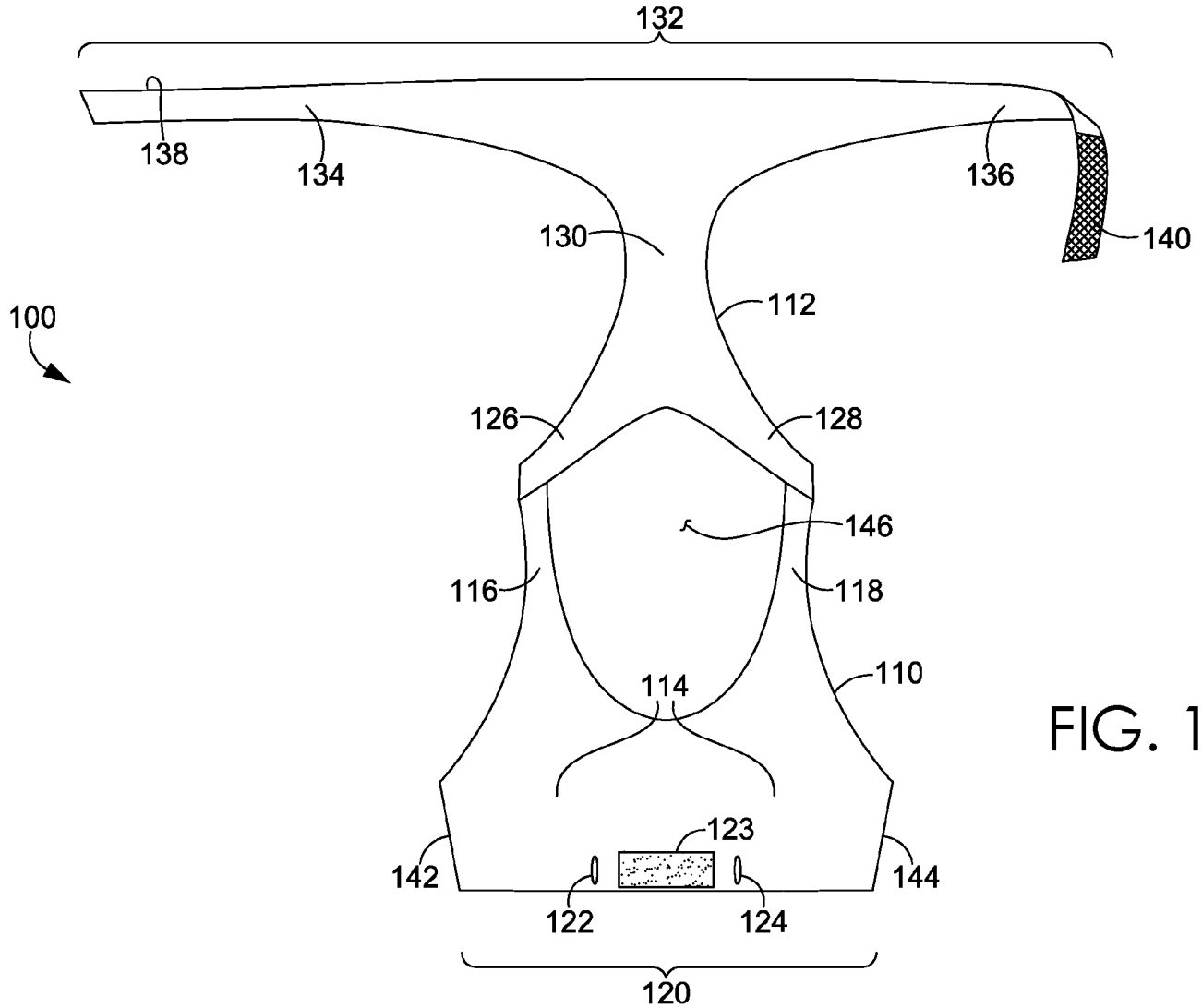
FIG. 1 illustrates a top view of an exemplary sport bra having an adjustable underband tightening assembly when in an un-assembled and laid-flat configuration in accordance with aspects hereof.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein provide for a racerback sport bra having a front portion and a back portion where the front portion of the sport bra is unaffixed to the back portion of the sport bra except for a pair of shoulder straps when the sport bra is in an as-constructed but un-assembled configuration. The sport bra described herein comprises an adjustable underband tightening assembly that enables an underband segment of the back portion of the sport bra to be releasably and adjustably secured to an underband segment of the front portion of the sport bra when the sport bra is in an as-worn or assembled configuration. Moreover, by configuring the sport bra such that the underband segment of the back portion of the bra is releasably and adjustably secured to the underband segment of the front portion, the girth of the sport bra can be loosened when donning or doffing the sport bra and tightened once the sport bra is on a wearer's body thus allowing the sport bra to be more easily donned or doffed.

To further facilitate the donning and doffing process, the adjustable underband tightening assembly may be used to generally disengage the front portion of the bra from the back portion of the sport bra when donning or doffing the sport bra. In this instance, the bra would be donned and doffed via the wearer inserting her head through the head opening created by the shoulder straps. Once donned, for instance, the wearer could adjustably and releasably secure the underband segment of the back portion to the underband segment of the front portion by using the adjustable underband tightening assembly. Further, once donned, the adjustable underband tightening assembly may allow the wearer to adjust the girth of the sport bra to, for example, provide increased support or to lessen the support if needed.

Exemplary sport bras having the adjustable underband tightening assembly described herein enable the wearer to select a sport bra having the needed cup size, and customize the sport bra to the wearer's particular girth by utilizing the adjustable underband tightening assembly. The use of the adjustable underband tightening assembly as described herein also benefits the manufacturer of the sport bra by decreasing the need to manufacture multiple bras having the same cup size but different girths.

In one illustrative aspect, the sport bra comprises a front portion having at least a pair of breast cups, a pair of shoulder straps, and a front underband segment located under the breast cups. As used throughout this disclosure, the term "breast cups" is meant to signify a general region of the sport bra that covers the wearer's breasts. The term "cup" is not meant to be limited to an actual cup-like structure as that term is used within the art, although cup-like structures are within the scope of the aspects discussed herein. Further, the pair of breast cups may comprise a single piece of material that covers both of the wearer's breasts and lacks a clear demarcation between the right breast region and the left breast region. In another example, the pair of breast cups may comprise a piece of material that primarily covers the right breast region and a piece of material that primarily covers the left breast region with a more defined demarcation between the two regions. Any and all such aspects, and any variation thereof, are contemplated as being within the scope herein. Further, as used throughout this disclosure, the term "underband" is meant to generally denote the lower or inferior portion of the sport bra when worn and may encompass the lower margin of the bra.

Continuing, the front underband segment is adapted to cover a front portion of the wearer's torso under the wearer's breasts when the sport bra is worn. The front underband segment comprises a first end and a second end where the first and second ends generally extend to a mid-axillary line of a wearer when the sport bra is worn. In one exemplary aspect, the front underband segment may comprise a pair of apertures located adjacent or next to a hypothetical midline that bisects the front portion into equal right and left halves. Moreover, in exemplary aspects, the front underband segment may comprise a releasable fastener mechanism and/or a securing means such as a double-loop slide buckle located between the apertures. The releasable fastener mechanism may comprise, for example, hook-and-loop fasteners, buttons, snaps, hooks, eyes, releasable adhesives, and the like. In another exemplary aspect, the front underband segment may comprise releasable fasteners located adjacent to the first and second ends of the front underband segment. Any and all aspects, and any variation thereof, are contemplated as being within the scope herein.

The sport bra further comprises a back portion having a central body portion from which a pair of shoulder straps extends. The shoulder straps of the back portion may be fixedly or releasably secured to the shoulder straps of the front portion. The back portion further comprises a back underband segment located at the lower margin of the central body portion. In exemplary aspects, the back underband segment comprises a first wing and a second wing which extend away from respective first and second sides of the back underband segment and end in a first free end and a second free end respectively. In an exemplary aspect, the first and second free ends and/or the first and second wings may have some type of releasable fastening mechanism located thereon such as, for example, hook-and-loop fasteners, hook-and-eye closures, buttons, snaps, hooks, releasable adhesives, and the like.

In an as-worn configuration, in exemplary aspects, each of the first and second free ends of the wings of the back underband segment may be wrapped around the sides of the wearer to the front underband segment and releasably and adjustably secured to the front underband segment. This may be accomplished in a number of different ways. For instance, in one exemplary aspect, the free ends may be threaded or inserted through a respective aperture on the front underband segment such that the free ends are positioned on the exterior face of the front underband segment after threading. Once threaded through the apertures, the free ends may subsequently be releasably and adjustably secured to each other and/or to a releasable fastener mechanism located between the apertures on an outer-facing surface of the front underband segment. In another exemplary aspect, the first and second free ends may be threaded through the apertures located on the front underband segment and subsequently threaded through a securing means, such as a double-loop slide buckle located between the apertures on the outer-facing surface of the front underband segment. Once threaded through the securing means, the ends may be folded back on themselves and secured using some form of a releasable fastener mechanism. Moreover, the folded-over ends may be subsequently secured in a pocket or channel on the front underband segment to prevent the folded-over ends from interfering with wearer movement.

Continuing, in an additional exemplary aspect, the wings of the back underband segment may be wrapped around the sides of the wearer and releasably and adjustably secured to releasable fastener mechanisms located adjacent to the first and second ends of the front underband segment. In other words, the free ends of the wings may be secured generally along a mid-axillary line of a wearer when the bra is worn. Any and all aspects, and any variation thereof, are contemplated as being within the scope herein.

When a wearer wishes to don the sport bra, the wearer can loosen and/or disengage the front portion of the bra from the back portion of the bra by releasing or partially releasing the free ends of the wings of the back underband segment, adjusting the girth of the sport bra to a larger size, donning the sport bra by pulling the sport bra over the wearer's head, and subsequently tightening the girth of the sport bra by pulling on the free ends until the desired girth is obtained. The free ends can then be adjustably and releasably secured to, for instance, the front underband segment. Doffing the sport bra would follow a similar series of steps (e.g., loosening the front portion of the bra from the back portion of the bra using the adjustable underband tightening assembly prior to pulling the sport bra over the wearer's head). The girth of the sport bra may be adjusted by increasing and/or decreasing the amount of overlay of the free ends of the back underband segment on the front underband segment. The result is a sport bra that not only has a customizable girth, but also a sport bra that can easily be donned and doffed while still providing adequate support to the wearer's breasts during sports activities.

Turning now to FIG. 1, FIG. 1 illustrates a top plan view of an exemplary sport bra 100 having an adjustable underband tightening assembly in an un-assembled and laid-flat arrangement in accordance with aspects described herein. Although the term "un-assembled" is used in this disclosure, this term does not imply that the bra is an un-constructed state. Instead, this term means that the front portion is disengaged from the back portion except for the shoulder straps. While aspects discussed herein refer to bras, moreover, it will be understood that aspects are not limited to any particular style or type of support garment used to support breast tissue. For example, other support garments may comprise camisoles, swimwear, or other garments with built-in support. Further, the depictions in the drawings are for exemplary purposes only and are in no way meant to limit the scope of the aspects described herein.

The sport bra 100 comprises a front portion 110 and a back portion 112 fixedly or releasably secured to the front portion 110 by a set of shoulder straps 116, 118, 126, and 128 that define an opening 146 through which a wearer's head can be inserted and/or removed. With respect to the front portion 110, the front portion 110 is adapted to cover a wearer's breasts and a portion of the wearer's torso when the sport bra 100 is worn. The front portion 110 may be constructed from a woven or knit material that has a degree of elasticity, compression, and/or stretch sufficient to provide support to a wearer's breasts. The front portion 110, in exemplary aspects, comprises breast cups 114, shoulder straps 116 and 118, and a front underband segment 120. The breast cups 114 may be structured or unstructured and are adapted to cover the wearer's breasts when the sport bra 100 is worn. The shoulder straps 116 and 118 extend from an upper region or margin of the breast cups 114 and are adapted to extend up to and/or over the wearer's shoulders when the sport bra 100 is worn. The material used to form the breast cups 114 and/or the shoulder straps 116 and 118 may comprise natural or man-made fibers having a degree of elasticity, compression, and/or stretch so as to provide support to the wearer's breasts when the sport bra 100 is worn.

The front underband segment 120 extends from a lower margin of the pair of breast cups 114 and is adapted to cover a front portion of the wearer's torso below the wearer's breasts when the sport bra 100 is worn. The front underband segment 120 has a first end 142 and a second end 144. The front underband segment 120 may have a length such that the first end 142 and the second end 144 terminate at approximately a mid-axillary line of a wearer when the sport bra 100 is worn.

In exemplary aspects, the front underband segment 120 comprises a pair of apertures 122 and 124 located adjacent to a hypothetical midline that bisects the front portion 110 into equal right and left halves. The apertures 122 and 124 may extend completely through the material forming the front underband segment 120. The front underband segment 120 may further comprise an optional releasable fastener mechanism 123 located between the apertures 122 and 124 at an approximate mid-point of the front underband segment 120. The releasable fastener mechanism 123 may comprise, for example, hook-and-loop fasteners, hooks, eyes, snaps, buttons, releasable adhesives, and the like.

The back portion 112 of the exemplary sport bra 100 may be cut or formed in a racerback shape such that it has a central body portion 130, shoulder straps 126 and 128 extending from an upper margin of the central body portion 130 that are fixedly secured (e.g., via stitching, bonding, welding, etc.) or releasably secured (e.g., via a quick-release buckle, hook-and-loop fasteners, etc.) to the shoulder straps 116 and 118 respectively, and a back underband segment 132. The back portion 112 may be separately constructed from the front portion 110 and secured in part to the front portion 110 via the shoulder straps 126 and 128. The back portion 112 may be constructed from similar materials as the front portion 110 or it may be constructed from materials that have, for example, less stretch, compression, and/or elasticity and more breathability (e.g., mesh-like materials). In an additional aspect, the front portion 110 and the back portion 112 may be constructed from a single piece of material such as an engineered knit or woven fabric. Any and all such aspects, and any variation thereof, are contemplated as being within the scope herein.

The back underband segment 132 of the exemplary sport bra 100 extends from a lower margin of the central body portion 130 and comprises wings 134 and 136 that extend laterally away from respective sides of the back underband segment 132 and terminate in a first end 138 and a second end 140 respectively. The back underband segment 132 may have a length sufficient for the wings 134 and 136 to wrap around the sides of a wearer when the bra 100 is worn and be secured to the front underband segment 120 as discussed below. In exemplary aspects, the wings 134 and 136 may have some type of releasable fastener mechanism located on an inner-facing surface adjacent to the first end 138 and the second end 140 such as, for example, hook-and-loop fasteners, hook-and-eye fasteners, buttons, snaps, a releasable adhesive, and the like as shown by the cross-hatching on the turned-back portion of the wing 136. The wings 134 and 136 may comprise contiguous extensions of the back underband segment 132, and, as such, be constructed of the same material as the back underband segment 132 and/or back portion 112. Alternatively, the wings 134 and 136 may be separately constructed and affixed to the back underband segment 132 via, for example, stitching, bonding, welding, adhesives, and the like. With respect to this aspect, the wings 134 and 136 may be constructed from materials different from those used to construct the back portion 112 and/or the front portion 110.

Figure 2:
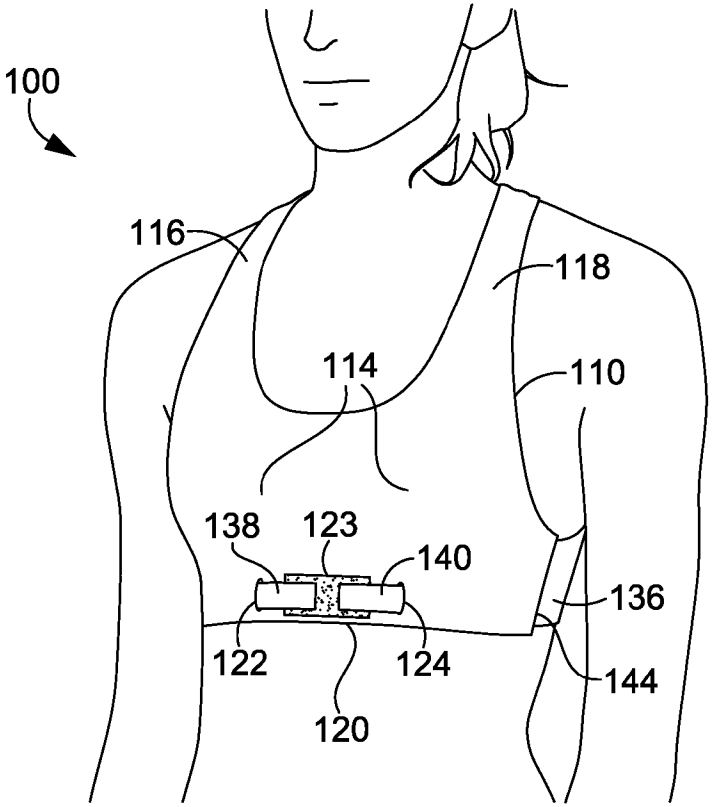
FIG. 2 illustrates a front perspective view of the exemplary sport bra having the adjustable underband tightening assembly of FIG. 1 in an as-worn position in accordance with aspects hereof.

FIG. 2 illustrates a front perspective view of a wearer wearing the sport bra 100 in accordance with aspects described herein. FIG. 2 depicts the wing 136 extending around the left side of the wearer and traveling underneath the front underband segment 120 such that the outer-facing surface of the wing 136 abuts the inner-facing surface of the front underband segment 120. Because of the perspective view of FIG. 2, the wing 134 is not shown, but the discussion of the wing 136 is equally applicable to the wing 134. The first and second ends 138 and 140 are adapted to be threaded through the apertures 122 and 124 respectively. More specifically, the first and second ends 138 and 140 are adapted to be threaded through an inner-facing portion of the apertures 122 and 124. After being threaded through the inner-facing portion of the apertures 122 and 124, the first and second ends 138 and 140 may be positioned on the outer-facing surface of the front underband segment 120. The first and second ends 138 and 140 may be releasably and adjustably secured to the releasable fastener mechanism 123 located on the front underband segment 120 between the apertures 122 and 124. As such, the girth of the sport bra 100 may be increased and/or decreased by altering the amount of overlay of the first and second ends 138 and 140 on the releasable fastener mechanism 123.

Figure 3:
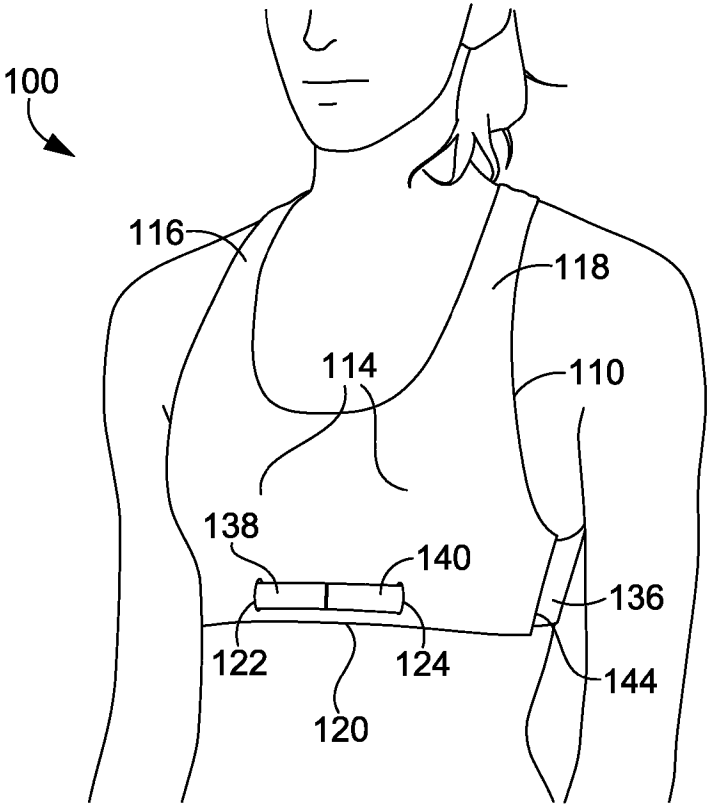
FIG. 3 illustrates an additional aspect of the exemplary sport bra having the adjustable underband tightening assembly of FIG. 1 in an as-worn position in accordance with aspects hereof.

FIG. 3 illustrates an additional aspect for the exemplary sport bra 100 of FIG. 1 in accordance with aspects herein. In this aspect, the front underband segment 120 comprises the apertures 122 and 124 but does not include the releasable fastener mechanism 123. Thus, after being threaded through the apertures 122 and 124 the first and second ends 138 and 140 of the back underband segment 132 are secured directly to one another using, for instance, releasable fastener mechanisms located on or adjacent to the first and second ends 138 and 140 and/or other fastener mechanism such as clasps, hood-and-eye closures, and the like. Any and all aspects, and any variation thereof, are contemplated as being within the scope herein.

Figure 4:
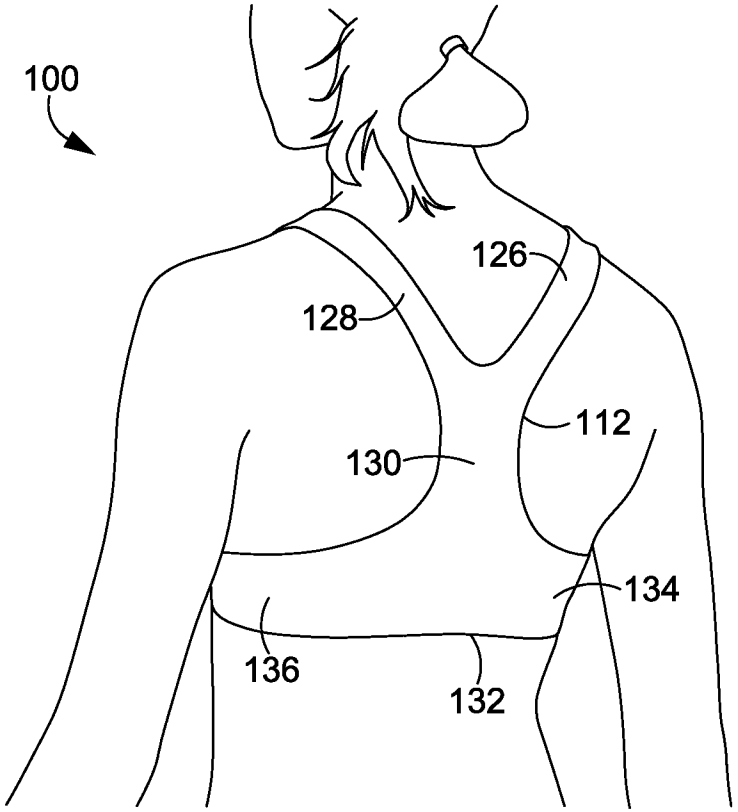
FIG. 4 illustrates a back perspective view of the exemplary sport bra having the adjustable underband tightening assembly of FIG. 1 in the as-worn position in accordance with aspects hereof.

FIG. 4 illustrates a back perspective view of the wearer wearing the exemplary sport bra 100 of FIG. 1 in accordance with aspects described herein. As shown, the central body portion 130 of the back portion 112 is adapted to generally overlay the wearer's torso between the wearer's shoulder blades. The shoulder straps 126 and 128 extend from an upper margin of the central body portion 130 and are adapted to extend up and/or over the wearer's shoulders. The back underband segment 132 extends from a lower margin of the central body portion 130 and is adapted to cover a portion of the wearer's torso. As depicted, the wings 134 and 136 are adapted to extend laterally away from the back underband segment 132, be wrapped around the sides of the wearer, and be releasably and adjustably secured to the front underband segment 120 as discussed above with respect to FIGS. 2 and 3.

Figure 5:
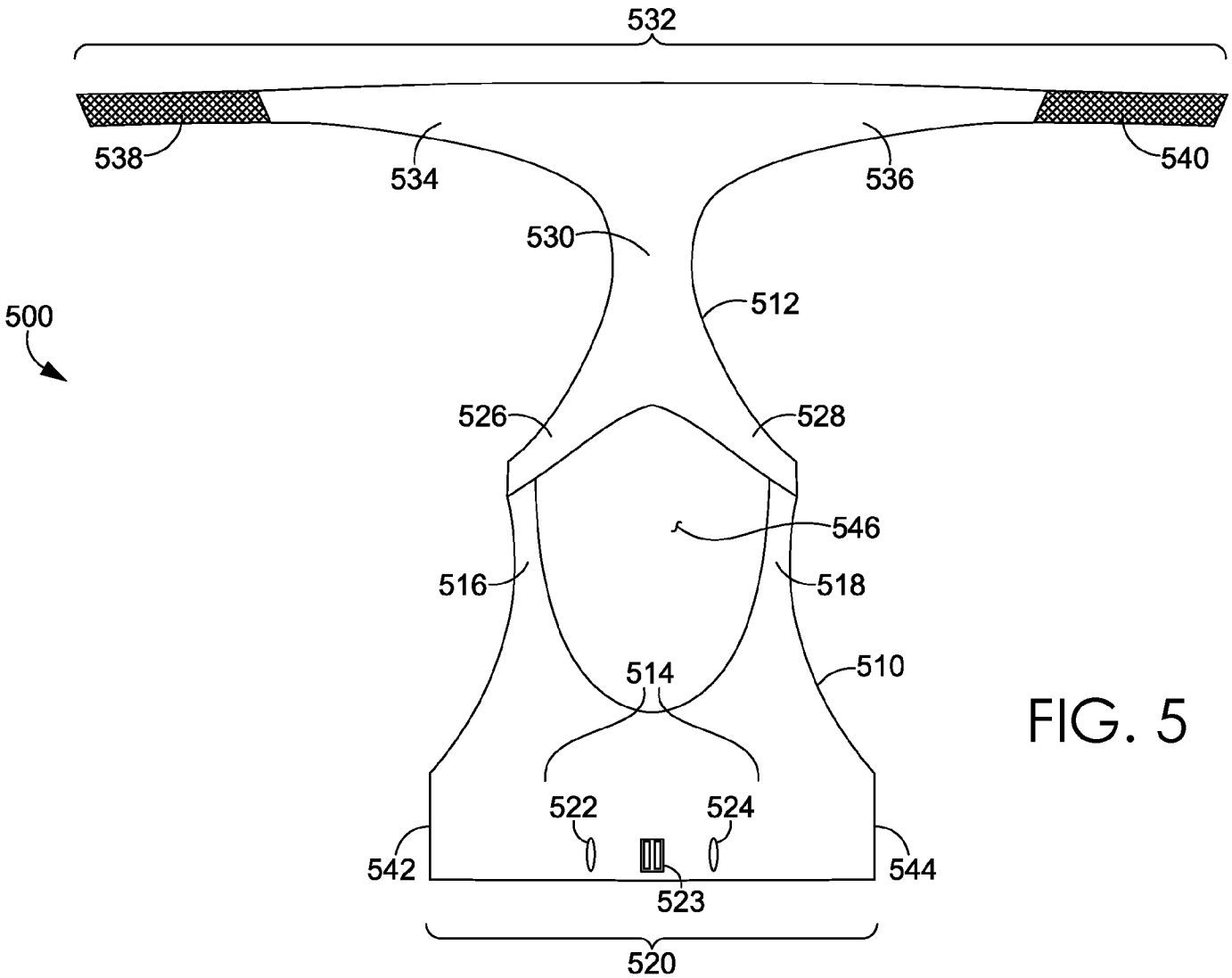
FIG. 5 illustrates a top view of an exemplary wrap front sport bra having an adjustable underband tightening assembly when in an un-assembled and laid-flat configuration in accordance with aspects hereof.

Turning now to FIG. 5, a top plan view of an exemplary sport bra 500 having an adjustable underband tightening system in an un-assembled and laid-flat configuration is shown in accordance with aspects herein. The sport bra 500 shares similar features with the sport bra 100 and, as such, the description of these features provided with respect to the sport bra 100 is equally applicable to the sport bra 500.

The sport bra 500 comprises a front portion 510 and a back portion 512 where the front portion 510 is releasably and/or fixedly secured to the back portion 512 by a set of shoulder straps 516, 518, 526, and 528 that define an opening 546 through which a wearer's head can be inserted and/or removed. With respect to the front portion 510, the front portion 510 comprises a pair of breast cups 514 and a pair of shoulder straps 516 and 518 extending from an upper margin of the pair of breast cups 514 and adapted to extend up to and/or over a wearer's shoulders when the bra 500 is in an as-worn configuration.

The front portion 510 further comprises a front underband segment 520 that extends from a lower margin of the pair of breast cups 514. The front underband segment 520 terminates in a first end 542 and a second end 544. The front underband segment 520 may have a length such that when the sport bra 500 is worn the first and second ends 542 and 544 are adapted to be located generally along a mid-axillary line of the wearer.

The front underband segment 520 further comprise apertures 522 and 524 located on either side of a hypothetical midline that bisects the front portion 510 into equal right and left halves. In exemplary aspects, the apertures 522 and 524 are configured to extend completely through the thickness of the front underband segment 520. Moreover, in exemplary aspects, the apertures 522 and 524 may be configured to each have a pocket or channel extending laterally along the front underband segment 520 for a preconfigured distance. Continuing, located between the apertures 522 and 524 at an approximate midpoint of the front underband segment 520 is a securing means 523. In exemplary aspects, the securing means 523 may comprise a double-loop slide buckle although other securing means are contemplated as being within aspects discussed herein.

The back portion 512 of the sport bra 500 comprises a central body portion 530 and a pair of shoulder straps 526 and 528 extending from an upper margin of the central body portion 530. In exemplary aspects, the straps 526 and 528 are adapted to be releasably (e.g., via quick release buckles) and/or securedly affixed (e.g., via stitching, bonding, and the like) to the straps 516 and 518 of the front portion 510 respectively. Extending from a lower margin of the central body portion 530 is a back underband segment 532. The back underband segment 532 comprises wings 534 and 536 extending laterally away from respective sides of the back underband segment 532. The wing 534 terminates in a first end 538, and the wing 536 terminates in a second end 540. A releasable fastener mechanism (indicated by cross-hatching) may be located on an outer-facing surface of the wings 534 and 536 adjacent to the first and second ends 538 and 540.

Figure 6:
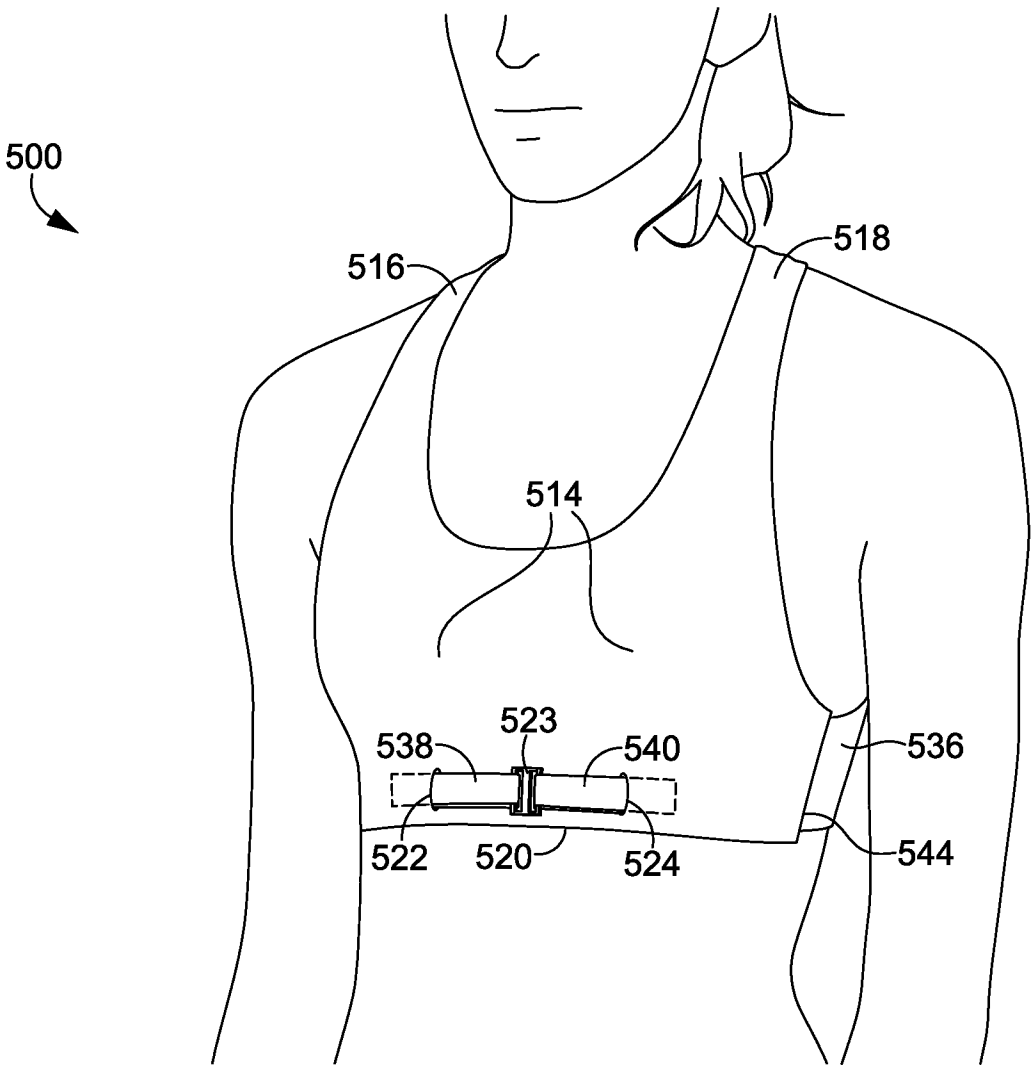
FIG. 6 illustrates a front perspective view of the exemplary sport bra having the adjustable underband tightening assembly of FIG. 5 in an as-worn position in accordance with aspects hereof.

FIG. 6 depicts a front perspective view of the sport bra 500 in an as-worn configuration in accordance with aspects herein. In the as-worn configuration, the wings 534 and 536 of the back underband segment 532 are configured to be wrapped around the sides of the wearer and positioned such that the outer-facing surface of the wings 534 and 536 is adjacent to an inner-facing surface of the front underband segment 520. The first and second ends 538 and 540 are adapted to be threaded through the apertures 522 and 524 respectively. More specifically, the first and second ends 538 and 540 are adapted to be threaded through an inner-facing portion of the apertures 522 and 524. Once threaded through the apertures 522 and 524, the first and second ends 538 and 540 are positioned on the outer-facing surface of the front underband segment 520. The first and second ends 538 and 540 may then be threaded through the securing means 523 and folded back onto themselves. The releasable fastener mechanism located on the outer-facing surface of the wings 534 and 536 may then be utilized to secure the folded-back ends 538 and 540. In an exemplary aspect, each of the first and second ends 538 and 540 may be secured in a channel or pocket associated with the apertures 522 and 524 as indicated by the dashed line. The channel or pocket may be formed by, for instance, securing an additional panel to the front portion 510 and/or by integrally forming the channel or pocket through a weaving or knitting process. Securing the first and second ends 538 and 540 helps to prevent them from interfering with the wearer's movements during activities. It also provides a more visually-pleasing aesthetic to the sport bra 500. A back view of the wearer wearing the bra 500 would be similar to that shown in FIG. 4.

Figure 7:
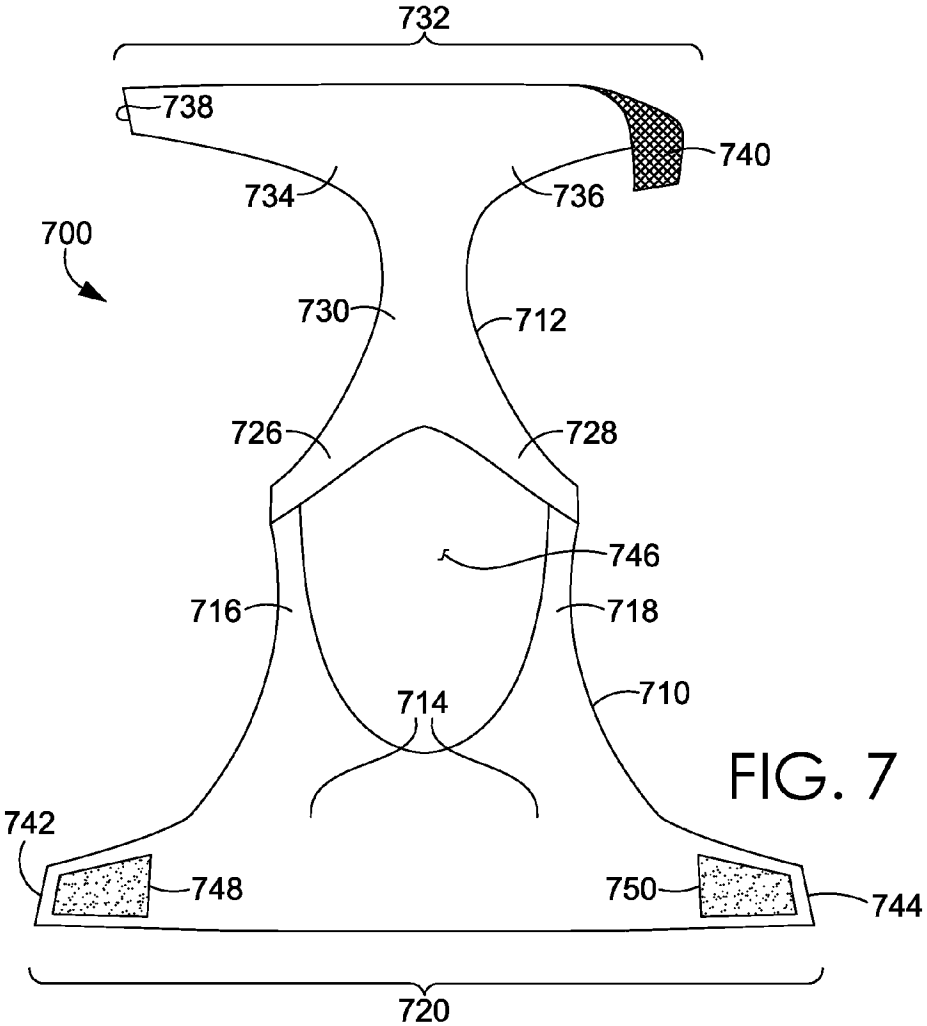
FIG. 7 illustrates a top view of an exemplary wrap front sport bra having an adjustable underband tightening assembly when in an un-assembled and laid-flat configuration in accordance with aspects hereof.

FIG. 7 illustrates a top plan view of an exemplary sport bra 700 having an adjustable underband tightening assembly in an as-assembled and laid-flat configuration in accordance with aspects herein. The sport bra 700 shares similar features with the sport bras 100 and 500. The discussion of these features given for the bra 100 and the bra 500 is equally applicable to the bra 700.

The bra 700 comprises a front portion 710 and a back portion 712 releasably or fixedly secured to one another by a set of shoulder straps 716, 718, 726, and 728. The set of shoulder straps 716, 718, 726, and 728 define an opening 746 through which a wearer's head can be inserted and/or removed when donning or doffing the sport bra 700. The front portion 710 comprises a pair of breast cups 714 from whose upper margin the shoulder straps 716 and 718 extend. A front underband segment 720 extends from a lower margin of the pair of breast cups 714. The front underband segment 720 terminates in a first end 742 and a second end 744. The front underband segment 720 may have a length sufficient such that the first and second ends 742 and 744 are adapted to extend generally to a mid-axillary line of a wearer when the bra 700 is in an as-worn configuration. Releasable fastener mechanisms 748 and 750 may be located adjacent to the first and second ends 742 and 744 respectively on an outer-facing surface of the front underband segment 720. The releasable fastener mechanisms 748 and 750 may comprise, for example, hook-and-loop fasteners, hook-and-eye closures, snaps, buttons, releasable adhesives, and the like.

The back portion 712 comprises a central body portion 730. The shoulder straps 726 and 728 extend from an upper margin of the central body portion 730 and are releasably and/or fixedly secured to the shoulder straps 716 and 718 respectively. A back underband segment 732 extends from a lower margin of the central body portion 730. Wings 734 and 736 extend laterally away from respective sides of the back underband segment 732 and terminate in a first end 738 and a second end 740 respectively. A releasable fastener mechanism may be located on an inner-facing surface of the wings 734 and 736 adjacent to the first and second ends 738 and 740 as indicated by cross-hatching. The back underband segment 732, in exemplary aspects, may have a length sufficient such that the first and second ends 738 and 740 are adapted to terminate at generally a mid-axillary line of wearer when the bra 700 is in an as-worn configuration.

Figure 8:
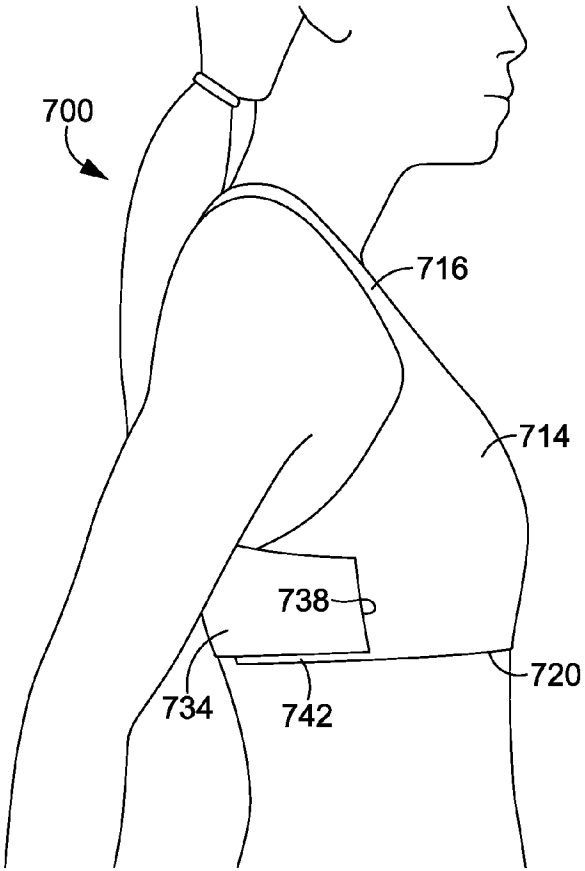
FIG. 8 illustrates a side perspective view of the exemplary sport bra having the adjustable underband tightening assembly of FIG. 7 in an as-worn position in accordance with aspects hereof.

FIG. 8 is a right side perspective view of the sport bra 700 of FIG. 7 in an as-worn configuration in accordance with aspects herein. In the as-worn configuration, the wings 734 and 736 are adapted to be brought around to the sides of the wearer such that the inner-facing surface of the wings 734 and 736 is adjacent to the outer-facing surface of the front underband segment 720. The first end 738 of the back underband segment 732 is adapted to be releasably and adjustably secured to the first end 742 of the front underband segment 720 by mating the releasable fastener located on the inner-facing surface of the first end 738 with the releasable fastener 748 located on the outer-facing surface of the first end 742. Similarly, the second end 740 of the back underband segment 732 is releasably and adjustably secured to the second end 744 of the front underband segment 720 by mating the releasable fastener located on the inner-facing surface of the second end 740 with the releasable fastener 750 located on the outer-facing surface of the second end 744. The girth of the sport bra 700 may be adjusted by increasing and/or decreasing the amount of overlap of the first and second ends 738 and 740 with the first and second ends 742 and 744.

Figure 9:
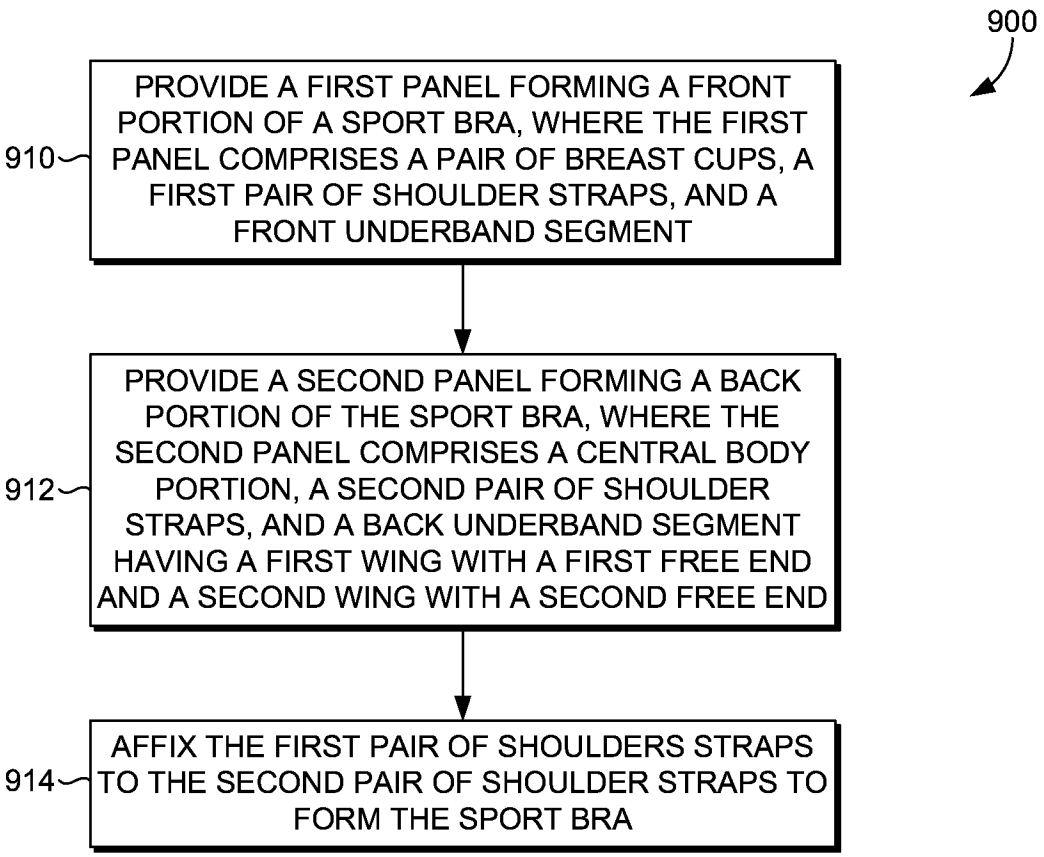
FIG. 9 illustrates a flow diagram of an exemplary method of manufacturing a sport bra having an adjustable underband tightening assembly in accordance with aspects hereof.

Turning now to FIG. 9, a flow diagram of a method 900 of manufacturing an exemplary sport bra having the adjustable underband tightening assembly described herein is provided. The exemplary sport bra may comprise the sport bra 100, the sport bra 500, and/or the sport bra 700 described herein. At a first step 910, a first panel forming a front portion of the sport bra is provided. The first panel comprises a pair of breast cups, a first pair of shoulder straps extending from an upper margin of the breast cups, and a front underband segment extending from a lower margin of the breast cups. In exemplary aspects, the front underband segment terminates in a first end and second end and has a length such that the first and second ends are located generally along a mid-axillary line of a wearer when the bra is in an as-worn configuration.

In exemplary aspects, the front underband segment may comprise a pair of apertures located adjacent to a hypothetical midline that bisects the front portion into equal right and left halves. In exemplary aspects, the apertures may be configured to have a pocket or channel that extends a predetermined distance laterally along the front underband segment. The front underband segment may also comprise a releasable fastener or a securing means between the apertures (e.g., at the midline of the front underband segment), and/or releasable fasteners located on an outer-facing and/or inner-facing surface of the front underband segment adjacent to the first and second ends.

At a step 912, a second panel forming a back portion of the sport bra is provided. The second panel comprises a central body portion, a second pair of shoulder straps extending from an upper margin of the central body portion, and a back underband segment. The back underband segment comprises a first wing and a second wing extending laterally away from the back underband segment and terminating in a first end and a second end. In exemplary aspects, releasable fastener mechanisms may be located on an inner-facing surface and/or an outer-facing surface of the wings and/or ends. The back underband segment may have a length such that when the bra is in an as-worn configuration, the first and second ends of the back underband segment extend to an approximate mid-point of the front underband segment. In other exemplary aspects, the back underband segment may have a length such that when the bra is in an as-worn configuration, the first and second ends of the back underband segment extend to an approximate mid-axillary line of the wearer. Moreover, in exemplary aspects, the back underband segment may have a length that is greater than or equal to the front underband segment. Any and all such aspects, and any variation thereof, are contemplated as being within the scope herein.

At a step 914, the first panel forming the front portion of the sport bra is affixed to the second panel forming the back portion of the sport bra to form the sport bra. More specifically, the first pair of shoulder straps is releasably or securedly affixed to the second pair of shoulder straps to form the sport bra. Once affixed, the first pair of shoulder straps and the second pair of shoulder straps define an opening through which the wearer's head can be inserted and/or removed when donning and doffing the sport bra.

In an alternative method of manufacture, the first and second panels may be formed as a single piece of engineered fabric via, for instance, a knitting or weaving process. In this aspect, there would be no need to affix the shoulder straps to each other as they would comprise a single construction. Moreover, with respect to this method of manufacture, the apertures and channels may be integrally formed through the knitting or weaving process used to form the bra.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the claims.

What is claimed is:

1. A bra comprising:

a back portion comprising at least:

a body portion, a first pair of shoulder straps extending from an upper margin of the body portion, and a back underband segment extending from a lower margin of the body portion and comprising a first wing extending laterally away from a first side of the back underband segment and terminating in a first end and a second wing extending laterally away from a second side of the back underband segment and terminating in a second end, wherein a first releasable fastener mechanism is located at the first end of the first wing and a second releasable fastener is located at the second end of the second wing, the back underband segment comprising a first length; and a front portion comprising at least:

a pair of breast covering structures, a second pair of shoulder straps extending from an upper margin of the pair of breast covering structures and secured to the first pair of shoulder straps, and a front underband segment having a third end and a fourth end, the front underband segment extending from a lower margin of the pair of breast covering structures, the front underband segment having a second length that is less than the first length of the back underband segment, wherein the front underband segment has at least a third releasable fastener mechanism associated therewith, and wherein the first releasable fastener mechanism and the second releasable fastener mechanism of the back underband segment are each releasably and adjustably coupled to the third releasable fastener mechanism of the front underband segment.

2. The bra of claim 1, wherein the first pair of shoulder straps are releasably secured to the second pair of shoulder straps.

3. The bra of claim 1, wherein the first pair of shoulder straps are fixedly secured to the second pair of shoulder straps.

4. The bra of claim 1, wherein the first releasable fastener mechanism and the second releasable fastener mechanism each comprise one of a hook component of a hook-and-loop fastener or a loop component of a hook-and-loop fastener.

5. The bra of claim 1, wherein the first releasable fastener mechanism and the second releasable fastener mechanism are each located on an inner-facing surface of the first end and the second end respectively.

6. The bra of claim 1, wherein the first releasable fastener mechanism and the second releasable fastener mechanism are each located on an outer-facing surface of the first end and the second end respectively.

7. The bra of claim 5, wherein the third releasable fastener mechanism comprises one of a hook component of a hook-and-loop fastener or a loop component of a hook-and-loop fastener.

8. The bra of claim 1, wherein the third releasable fastener mechanism is complementary to each of the first releasable fastener mechanism and the second releasable fastener mechanism.

9. The bra of claim 1, wherein the first length of the back underband segment is such that each of the first end and the second end of the back underband segment terminate at an approximate midpoint of the front underband segment when the first releasable fastener mechanism and the second releasable fastener mechanism are each releasably and adjustably coupled to the third releasable fastener mechanism of the front underband segment.

10. A bra comprising:

a back portion comprising at least:

a body portion, a first pair of shoulder straps extending from an upper margin of the body portion, and a back underband segment extending from a lower margin of the central body portion and comprising a first wing extending laterally away from a first side of the back underband segment and terminating in a first end and a second wing extending laterally away from a second side of the back underband segment and terminating in a second end, wherein a first releasable fastener mechanism is located on an inner-facing surface of the first end, and wherein a second releasable fastener mechanism is located on an inner-facing surface of the second end; and a front portion comprising at least:

a pair of breast covering structures, a second pair of shoulder straps extending from an upper margin of the pair of breast covering structures and secured to the first pair of shoulder straps, and a front underband segment having a third end and a fourth end, the front underband segment extending from a lower margin of the pair of breast covering structures, wherein:

a third releasable fastener mechanism is located on an outer-facing surface of the third end, the third releasable fastener mechanism releasably and adjustably coupled to the first releasable fastener mechanism, and a fourth releasable fastener mechanism is located on an outer-facing surface of the fourth end, the fourth releasable fastener mechanism releasably and adjustably coupled to the second releasable fastener mechanism.

11. The bra of claim 10, wherein the back underband segment comprises a first length extending between the first end and the second end.

12. The bra of claim 11, wherein the front underband segment comprises a second length extending between the third end and the fourth end.

13. The bra of claim 12, wherein the first length is such that each of the first end and the second end are adapted to extend generally to a respective mid-axillary line of a wearer when the bra is in an as-worn configuration.

14. The bra of claim 13, wherein the second length is such that each of the third end and the fourth end are adapted to extend generally to the respective mid-axillary line of the wearer when the bra is in the as-worn configuration.

15. A bra comprising:

a back portion comprising at least:

a body portion, and a back underband segment extending from a lower margin of the body portion, wherein the back underband segment comprises a first wing and a second wing extending laterally away from respective sides of the back underband segment, wherein the first wing terminates in a first end and the second wing terminates in a second end, and wherein a first releasable fastener mechanism is located on the first end of the first wing and a second releasable fastener mechanism is located on the second end of the second wing; and a front portion comprising at least:

a pair of breast covering structures, and a front underband segment extending from a lower margin of the pair of breast covering structures, wherein the front underband segment comprises a third end and a fourth end, wherein at least a third releasable fastener mechanism is located on the front underband segment, and wherein the back underband segment is releasably and adjustably coupled to the front underband segment via the first releasable fastener mechanism, the second releasable fastener mechanism, and the third releasable fastener mechanism.

16. The bra of claim 15, further comprising a pair of shoulder straps that connect the front portion with the back portion.

17. The bra of claim 15, wherein one or more of the first releasable fastener mechanism, the second releasable fastener mechanism, and the third releasable fastener mechanism comprise one or more of hook-and-loop fasteners, hook-and-eye closures, button, snaps, and releasable adhesives.

18. The bra of claim 15, wherein the back underband segment comprises a first length extending between the first end and the second end, and wherein the front underband segment comprises a second length extending between the third end and the fourth end.

19. The bra of claim 18, wherein the first length is greater than the second length.

20. The bra of claim 18, wherein the first length is generally the same as the second length.

* * * * *